United States Patent [19]

Broadfoot et al.

[11] 4,407,436

[45] Oct. 4, 1983

[54] METERING AND/OR FEEDING DEVICE FOR MATERIALS

[76] Inventors: John T. Broadfoot, 805 Eighth SW., Everett, Wash. 98204; John T. Broadfoot, Jr., Rte. 3, Box 3191, Sunnyside, Wash. 98944

[21] Appl. No.: 352,126

[22] Filed: Feb. 25, 1982

[51] Int. Cl.[3] ..... F04B 19/12

[52] U.S. Cl. ..... 222/636; 222/346; 222/370; 222/427; 417/477; 406/52; 406/192

[58] Field of Search ..... 406/194, 52, 76, 192, 406/118, 119; 222/636, 214, 207, 383, 370; 417/475, 476, 477; 222/346, 427

[56] References Cited

U.S. PATENT DOCUMENTS

| | | | |
|---|---|---|---|
| 2,015,123 | 9/1935 | Pennell | 417/477 |
| 2,629,333 | 2/1953 | Olden | 417/477 |
| 3,881,846 | 5/1975 | Kashmerick | 417/479 |

*Primary Examiner*—Joseph J. Rolla
*Assistant Examiner*—Patricia Kridler
*Attorney, Agent, or Firm*—Seed, Berry, Vernon & Baynham

[57] ABSTRACT

A metering and/or feeding device for materials is disclosed. A plurality of vertically oriented, elastic-walled tubes are arranged at equal distances from the axis of a rotatable helical rod which, as it rotates, sequentially engages and constricts each of the elastic-walled tubes, beginning at their upper portions and progressively moving down the length of the tubes. The material being metered and/or fed is introduced into the elastic-walled tubes at their upper ends. A cover member is provided to cover the infeed ends of the tubes at selected intervals to prevent entry of the material being fed and/or metered into the tube at the time that the helical member engages the upper portion of the tube to constrict the tube so that it is substantially free of material. A plenum, through which a stream of pressurized gas is discharged, communicates with the discharge ends of each of the tubes, the gas conveying the material entering the plenum from the tubes to a work location.

11 Claims, 8 Drawing Figures

FIG. 3
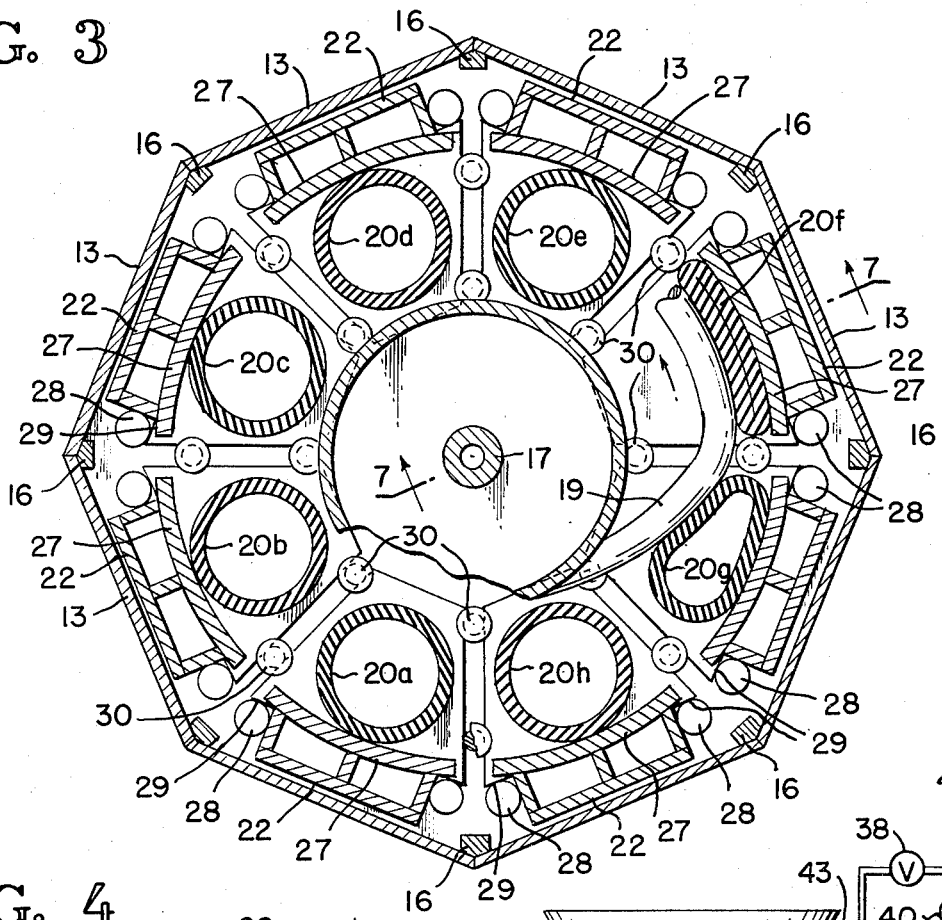
FIG. 4
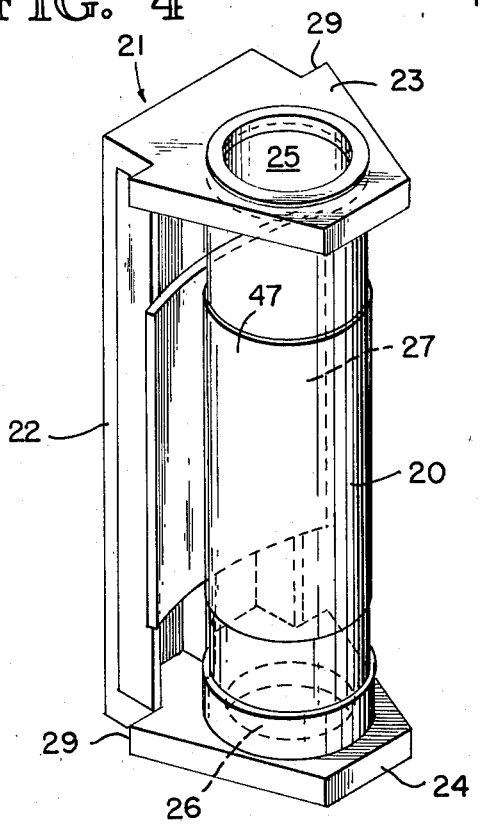
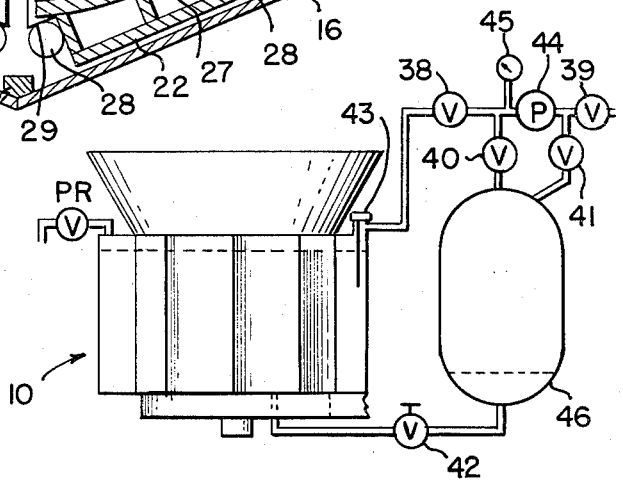
FIG. 6
FIG. 5
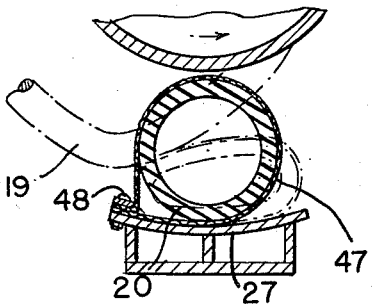

METERING AND/OR FEEDING DEVICE FOR MATERIALS

DESCRIPTION

1. Technical Field

This invention relates to a method and means of metering and/or feeding materials, including dry particulate materials and semi-liquid materials.

2. Background Art

Finely divided particulate materials, such as Gunite, a sand-cement mixture, are difficult to feed. Several methods are known for feeding dry sand-cement mixtures to a nozzle with compressed air where it is wet with a proper amount of water and applied to a work surface. In general, the prior art machines utilize a pressure vessel, pressurized multiple chambers or a tapered rotary valve.

The Allentown Pneumatic Gun Company manufactures a feeder having single or dual chambers. With dual chambers, the material is discharged by compressed air from a lower chamber while the upper chamber is being filled with material. An operator is required to cycle feeding of the material from the upper chamber to the lower. The upper chamber must be vented to the atmosphere before refilling.

Nucretor pneumatic spraying equipment manufactured by The Nucrete Group of Companies, Melbourne, Australia, consists of a paddle mixer which discharges the granular material being fed into a feed chamber. In the feed chamber, a chain drive with fixed circular discs pulls a continuous stream of material through a rubber tube. Partway down the length of the tube, a series of air jets blows the material from between the fixed discs through a hose. No pressure vessel is required; however, wear and maintenance are problems.

A further type of equipment, manufactured by Schü renberg Beton-Spritzmaschinen (SBS) GmbH of Essen, West Germany, utilizes a rotary-type tapered valve having multiple chambers for feeding materials intermittently to a pressurized chamber. Wear and sealing of the tapered valve is a problem. Also, the chambers in the rotary valve, after discharge of the material, must be vented to the atmosphere before being refilled.

NSF Industries of Troy, Mich., manufactures a unit which employs a multi-chambered rotor mounted within a housing. Compressed air enters through a fixed rotor liner having an opening therein communicating with the chambers of the rotor and forces material from the respective chambers. Intradym AG of Switzerland manufactures a unit operating on a similar principle.

Because of the necessity of venting in certain of the machines in use today, production capacity is limited. Venting also creates dusting problems and results in a waste of pressurized gas.

Peristaltic pumps are also known for pumping fluid and semi-fluid materials. U.S. Pat. No. 2,015,123 discloses a device for transferring blood to a recipient from a donor by pressing an elastic-walled tube filled with blood with a worm arranged parallel to the tube, the worm being rotated to impart a peristaltic movement to the worm. U.S. Pat. No. 2,629,333 discloses a liquid pump having an elastic-walled tube and a rotatable helical member engaging and progressively constricting the tube as the helical member is rotated. U.S. Pat. No. 3,669,574 discloses a peristaltic pump for underwater pumping of fluids.

U.S. Pat. No. 3,754,683 discloses a device for feeding dry particulate accelerator material for concrete into an airstream for entrainment which works in combination with a peristaltic pump.

DISCLOSURE OF INVENTION

This invention discloses a metering and feeding device for granular material utilizing at least one elastic-walled tube which is vertically oriented to hold the material to be fed. A rotatable helical member peripherally engages the tube to constrict the tube as the helical member rotates, beginning at the infeed end of the tube and ending at the discharge end. Means are included to periodically cover and uncover the feed end of the tube at selected intervals to prevent entry of material to be conveyed into the tube so that when the helical member engages and constricts the tube, that portion of the tube is substantially free of material. The metering and feeding device is housed in a container which may be filled with oil or other liquid to provide cooling and lubrication for the heat of friction generated during operation of the device. The material is discharged from the discharge end of the tube or tubes into a plenum through which a pressurized stream of gas is directed, the gas conveying the material to a work location.

The unit depends on gravity for discharge of the material, i.e., the material does not have to be blown out of the feeding chamber, and does not require venting to the atmosphere. Compared to means presently used for conveying sand-cement mixtures, the machine described in this application is capable of delivering such materials at a faster rate and for longer times without maintenance.

BRIEF DESCRIPTION OF THE DRAWINGS

FIG. 3 is a horizontal cross-section of the device of FIG. 1;

FIG. 4 is a perspective of a single modular unit including an elastic-walled tube and its mounting;

FIG. 5 is a partial horizontal cross-sectional view of a single elastic-walled tube and its corresponding hold-down means;

FIG. 6 is a schematic of the metering and feeding device of FIG. 1, together with means for filling and emptying a coolant, such as oil, through the container for the device;

BEST MODE FOR CARRYING OUT THE INVENTION

Figure 1:
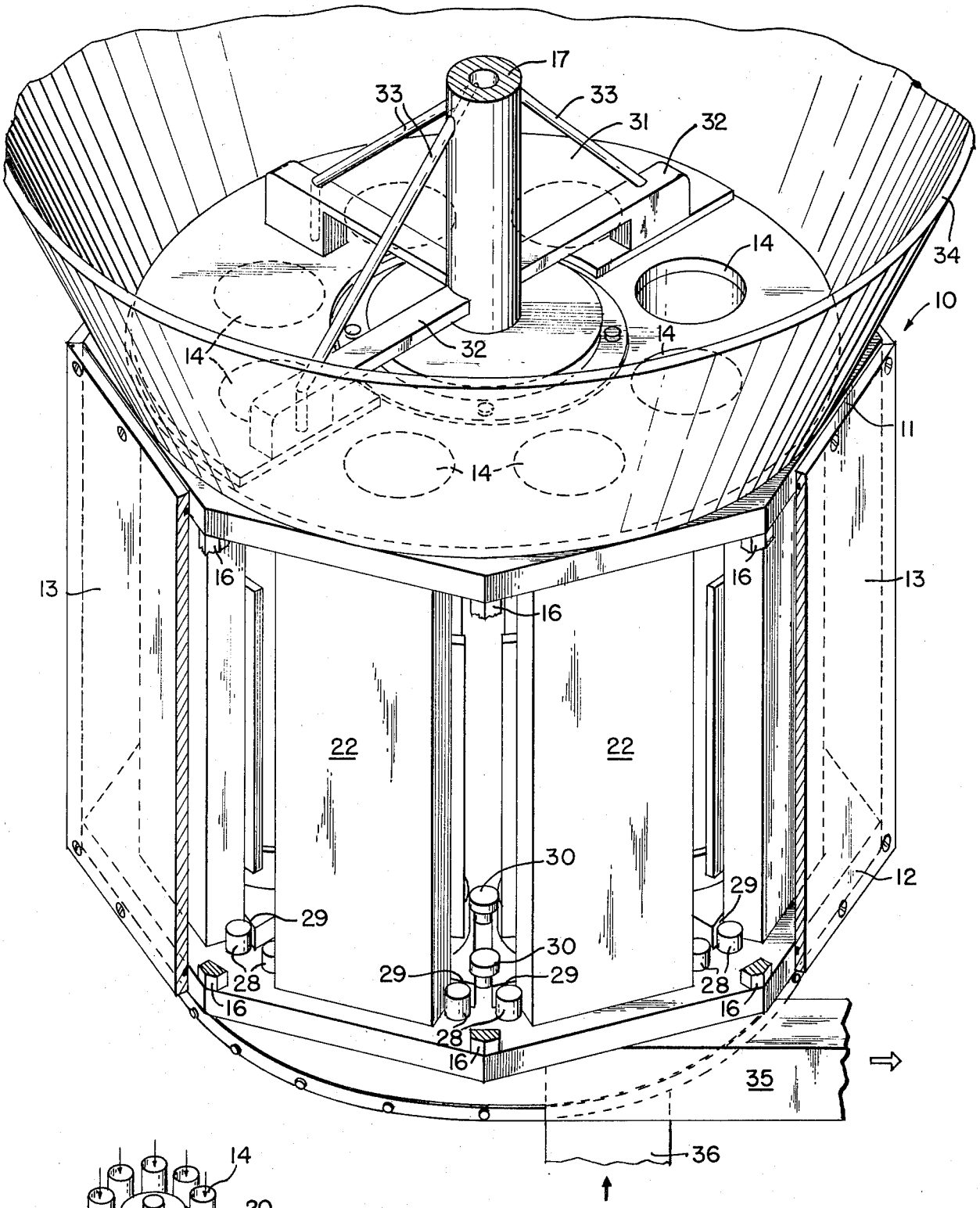
FIG. 1 is a perspective view of the metering and/or feeding device of this invention.
Figure 2:
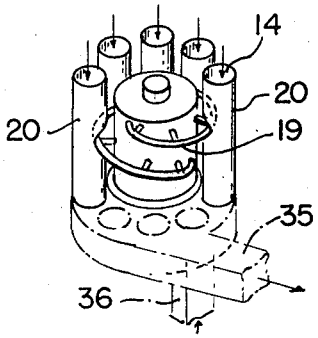
FIG. 2 is a perspective schematic view of the device of FIG. 1.

FIG. 1 illustrates a housing 10 for the metering and feeding device having an upper plate 11, a lower plate 12, the upper and lower plates joined by sidewalls 13. The upper and lower plates include a plurality of annular openings 14 and 15 spaced equidistantly about the central axis of the housing. The housing may also includes vertical supports 16 (see FIG. 3) at spaced intervals. The sidewalls are bolted to the upper and lower plates, respectively. Suitable gasketing is included near the top and bottom edges of the sidewalls and near the side edges to seal the unit. The gaskets near the side edges contact the vertical supports 16.

Figure 7:
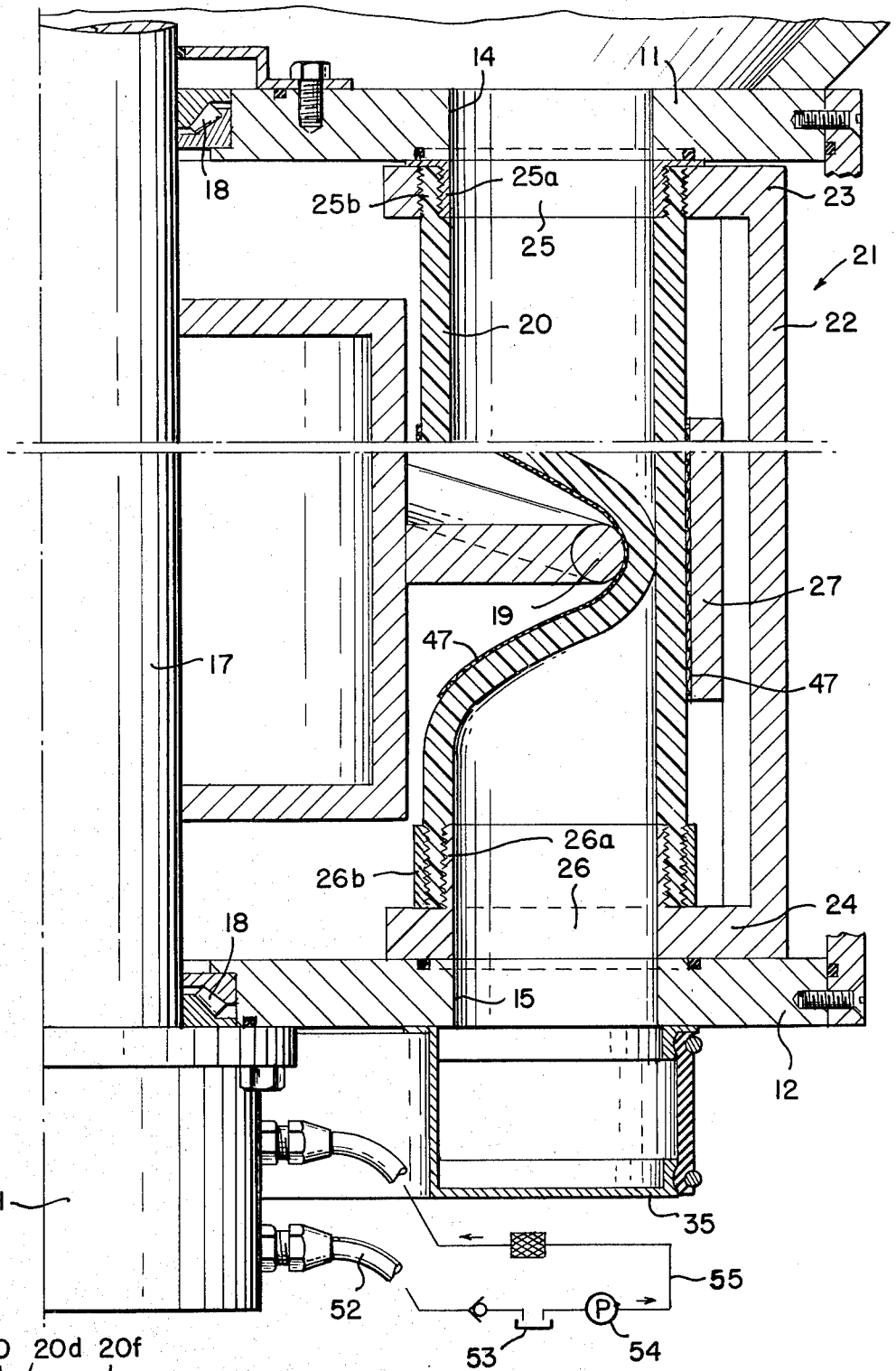
FIG. 7 is a vertical cross-sectional view along section line 7—7 of FIG. 3.

A shaft 17, coincident with and parallel to the axis of the housing, extends through respective openings in the top and bottom walls of the housing, as illustrated in FIG. 7. The shaft is journaled for rotation relative to the housing through bearings 18 which are mounted in the top and bottom openings of the shaft. Mounted to and surrounding the shaft is a rigid helical member 19, the function of which will be described.

Surrounding the shaft are a plurality of elastic-walled tubes 20*a* to 20*h* mounted in modular retainers 21 (see FIG. 4). Each of the retainers includes a back wall 22, a top wall 23 and bottom wall 24. The top and bottom walls include respective openings 25 and 26 which are coincident with openings 14 and 15 in respective top and bottom walls of the housing. The elastic-walled tube 20 of each of the retaining units is tightly secured at its upper end around a serrated fitting 25*a* surrounding the opening 25. The tubes 20 are cut to provide a smooth interior interface surface between the inner wall of the serrated fitting 25*a* and the interior surface of the elastic tube. A four-part clamp 25*b* is used to clamp the tube about the fitting 25*a*. Similarly, the lower end of the elastic tubing is tightly secured around the opening 26 by similar means. A smooth interface is provided between the interior surface of the tube and the fitting 26*a* surrounding the opening 15. A clamp 26*b* clamps the tube about the fitting. A backstop 27, made of rubber or other resilient material (suitably about ½ inch in thickness), is mounted between the back wall 22 and tube 20 to contact the sidewall of the elastic tube adjacent the back wall of the retainer.

The respective modular retainers 21 are mounted in the housing as illustrated in FIGS. 1 and 4. Each of the modular retainers is retained in the housing by a series of pins 28 extending upwardly from the bottom wall 12 against which shoulders 29 formed on the bottom wall 24 of the respective modular retainers 21 rest. Although not shown, there are corresponding pins extending downwardly from the top wall 11 against which shoulders 29 formed on the top walls 23 rest. Additionally, retaining screws 30, threaded into and extending from the upper and lower walls 11 and 12, are used to hold the bottom and top walls 24 and 23 of each of the modular units to prevent lateral shift of each of the units. This is best illustrated in FIG. 3.

Referring to FIG. 1, a cover 31 covers, at any given time, certain of the spaced openings 14 through which the particulate material drops into the respective elastic tubes 20. The cover is secured to the shaft 17 for rotation therewith by spaced supports 32 and 33 and sequentially covers and uncovers respective openings 14. A hopper 34 holding the particulate material to be fed into the metering device has its discharge end fitted around the top 11 of the housing, as illustrated in FIG. 1. If necessary, vent openings to the atmosphere may be provided through the supports 33 in the cover 31 and shaft 17 to permit the tubes to reinflate after being compressed by the rod 19.

Secured to the bottom wall 12 and covering each of the bottom openings 15 through which the particulate material discharges is a plenum 35 into which pressurized air or other gas enters through port 36. The plenum includes a discharge end which conveys the material to a work location.

The housing is sealed and the interior of the housing filled with oil, lubricant, or other coolant. Referring to the schematic shown in FIG. 6, the housing is initially filled by opening valves 38 and 39 and closing valves 40, 41 and 42. An airtight filler cap 43 including an integral dipstick is opened and the housing filled with oil. The filler cap is then closed and the vacuum pump 44 started. A vacuum gauge 45 may be included to monitor the vacuum. The volume of oil held by the accumulator vessel 46 should approximately equal the volume of oil which is held in the housing.

If it is desired to drain the oil from the housing, the filler cap 43 is opened, valves 39, 40 and 42 opened, and valves 38 and 41 closed. The pump 44 is operated until the oil is moved to the vessel 46. To return oil to the housing, valves 39 and 40 are closed and valves 38, 41 and 42 opened. The pump 44, when operated, creates a vacuum in the housing and pressure in the accumulator 46. When all of the oil is transferred, valve 42 is closed.

To prevent lateral movement of the respective elastic-walled tubes 20 when engaged by the helical rod 19, each of the tubes is held within a flexible sling 47 (see FIG. 4) which is secured by rivets 48 or other suitable means to the back stop along the side of the back stop where the rod 19 first engages the elastic tube. The sling is suitably manufactured from a reinforced elastomeric material, such as neoprene, having a thickness of about ⅛ inch.

The elastic tubes 20 preferably have a wall thickness of about ½ inch and are fabricated of a woven, reinforced-rubber material having a smooth-surfaced interior wall.

METHOD OF OPERATION FOR THE DEVICE

Figure 8:
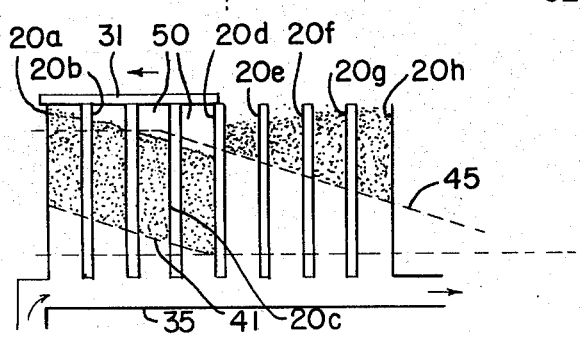
FIG. 8 is a schematic illustrating the manner in which the particulate material is fed from the respective elastic-walled tubes into the plenum as the helical member rotates to engage the tubes in sequential order.

Referring to FIGS. 1 and 8, particulate material held in the hopper 34 falls by gravity into the respective elastic tubes 20*e*, 20*f*, 20*g* and 20*h* not covered by the cover 31. In FIG. 8, reference numeral 45 refers to the areas where the helical rod 19 initially engages an elastic tube to squeeze it against the opposite sidewall of the tube, as indicated in FIG. 7. Note in FIG. 8 that the cover 31 covers tubes 20*a*, 20*b*, 20*c* and 20*d*. As the helical rod rotates, an air gap 50 is created beneath the cover 31. It is necessary to have this air gap so that when the helical rod 19 engages each of the elastic tubes 20 at their upper ends, the material in the tube will not prevent the tube from being flattened or constricted against the opposite wall of the tube, as illustrated in FIG. 7. The material in each of the tubes falls by gravity from the open discharge end of the tube into an airstream coursing through the plenum, where it is conveyed by the airstream for delivery to a desired work location. The tube constriction by the helical rod agitates the tube and prevents caking of the material in the tube.

The helical rod 19 and shaft 17 may be driven by a hydraulic motor 51, illustrated in FIG. 7. Hydraulic fluid is supplied to the hydraulic motor through line 52 from a reservoir 53 by a power source 54. The hydraulic fluid returns to the reservoir by way of line 55.

If desired, different materials may be fed to each of the elastic-walled tubes and discharged to different respective plenums or discharged into a common plenum for mixing. Also, rather than the cover 31 shown, any means of periodically opening and closing the infeed ends of the respective elastic tubes may be used.

It is possible to move large volumes of material with a device of the type illustrated—up to 1200/yds/hr with 12-inch tubes at 16 rotations/min.

We claim:

1. A feeding device for feeding material, comprising:

at least one vertical, open-ended, elastic-walled tube for the material to be fed having an open feed end and an open discharge end;

a rotatable helical member peripherally engaging the tube along its length to constrict the tube against itself as the helical member rotates about its axis; and means to cover and uncover the feed end of the tube at selected intervals to prevent entry of the material to be conveyed into the tube so that when the helical member engages the upper portion of the tube to constrict the tube, that portion of the tube is substantially free of material to be conveyed.

2. The device of claim 1, including a plenum communicating with the discharge end of the tube and a source of pressurized gas flowing through the plenum to convey the material discharged into the plenum.

3. The device of claim 1, including means for engaging and supporting the tube as the helical member progressively constricts the tube along its length.

4. The device of claim 1, including means preventing lateral movement of the tube when the helical member initially engages the tube.

5. The device of claim 1 including a plurality of said elastic-walled tubes arranged equidistantly about the axis of the helical member.

6. The device of claim 5, including means to allow the interior of the tubes to be vented periodically to the atmosphere to ensure their reinflation after constriction by the helical member.

7. The device of claim 5 wherein the tubes are housed within a container and the container is filled with a coolant.

8. A metering and feeding device for particulate material, comprising:

a helical rod adapted to be rotated about its axis;

a plurality of vertical, open-ended, elastic-walled tubes having upper infeed ends and lower discharge ends arranged about the helical rod so that the helical rod periodically and sequentially engages and constricts each of the tubes, beginning at their upper infeed ends and progressively moving toward their lower discharge ends;

means supporting each of the elastic-walled tubes in a fixed location;

means for feeding a particulate material into each of the elastic-walled tubes; and means to cover and uncover the upper ends of each of the tubes at selected intervals to prevent entry of the particulate material to be conveyed into the tube so that when the helical member engages the upper end of the tube to constrict the tube, that portion of the tube is substantially free of particulate material.

9. The metering and feeding device of claim 8, including a plenum communicating with the discharge ends of the tubes and a source of pressurized gas flowing through the plenum to convey the material discharged into the plenum.

10. The metering and feeding device of claim 8, including a housing and wherein the plurality of tubes are each mounted on modular units, removable from the housing.

11. The metering and feeding device of claim 10 wherein the housing for the device has a top wall and bottom wall, each of which is provided with annular openings coinciding with the infeed and discharge ends of the elastic-walled tubes mounted within the housing, and means supplying a liquid coolant to fill the housing and surround each of the elastic-walled tubes during operation of the device.

* * * * *